United States Patent [19]

Adany et al.

[11] Patent Number: 5,003,713

[45] Date of Patent: Apr. 2, 1991

[54] MULTI-ANNUAL CALENDAR

[76] Inventors: Shalom Adany, 26 Aharon Karon Street, Rishon Lezion; Amram Levi, Kfar Habad, both of Israel

[21] Appl. No.: 399,619

[22] Filed: Aug. 28, 1989

[30] Foreign Application Priority Data

Aug. 30, 1988 [IL] Israel ..... 87610

[51] Int. Cl.[5] ..... G09D 3/08

[52] U.S. Cl. ..... 40/113; 283/2

[58] Field of Search ..... 40/107, 109, 110, 113, 40/114, 489, 490, 495; 283/2, 3, 4

[56] References Cited

U.S. PATENT DOCUMENTS

| | | | |
|---|---|---|---|
| 1,439,080 | 12/1922 | Fenimore | 40/109 |
| 1,526,166 | 2/1925 | Manahan | 40/109 |
| 2,191,757 | 2/1940 | Hacker | 40/113 |
| 2,548,553 | 4/1951 | Neves | 40/113 |
| 3,605,307 | 9/1971 | Dickson | 40/109 |

*Primary Examiner*—Kenneth J. Dorner
*Assistant Examiner*—James Gardner
*Attorney, Agent, or Firm*—Ladas & Parry

[57] ABSTRACT

Apparatus for selectably displaying one of a plurality of predetermined combinations of first and second sets of symbols taken from respective first and second groups comprising first selectable display apparatus on which there is provided the first group of symbols; second selectable display apparatus on which there is provided the second group of symbols; and cover apparatus for the first and second selectable display apparatus defining first and second display locations for the respective first and second sets of symbols, the first and second display apparatus and the first and second locations being arranged such that any of the predetermined combinations may be selectably displayed at the first and second locations by operation of the first and second selectable display apparatus.

3 Claims, 7 Drawing Sheets

MULTI-ANNUAL CALENDAR

FIELD OF THE INVENTION

The present invention relates in general to numerical instruments and, in particular, to calendars.

BACKGROUND OF THE INVENTION

Calendars are well known and have been widely used for many years. A typical calendar, such as a wall-chart type, includes a display showing selected periods of time in varying forms. Thus, wall calendars may comprise a plurality of tear-off or fold-over pages, each of which displays a day, week or month and the calendar may cover a total period of a single year or a few years. Wall calendars that show a single year on a single display surface are also known.

A disadvantage of the different sorts of calendar described is that the period covered by them is conventionally not more than a few years and normally not more than a single year, due to limited display space on the calendar. Therefore, the calendar ceases to be useful after a relatively short period of, at the most, a few years and a new calendar must be used.

It would be desirable for a calendar to cover an extended period of time such that replacement thereof at relatively short intervals is not required.

SUMMARY OF THE INVENTION

It is an aim of the present invention to provide a wall calendar covering an extended period of time, namely, a twenty eight year solar cycle, wherein the calendar is relatively compact while its display characters are sufficiently large so as to be conveniently read.

There is provided, therefore, in accordance with an embodiment of the invention, apparatus for selectably displaying one of a plurality of predetermined combinations of first and second sets of symbols taken from respective first and second groups comprising first selectable display apparatus on which there is provided the first group of symbols; second selectable display apparatus on which there is provided the second group of symbols; and cover apparatus for the first and second selectable display apparatus defining first and second display locations for the respective first and second sets of symbols, the first and second display apparatus and the first and second locations being arranged such that any of the predetermined combinations may be selectably displayed at the first and second locations by operation of the first and second selectable display apparatus.

Additionally in accordance with an embodiment of the invention, the apparatus also includes third selectable display apparatus on which there is provided a third group of symbols supplementary to the second group of symbols, the second display apparatus defining a plurality of third display locations at which a third set of symbols, taken from the third group, may be displayed at the third display location so as be observable through the second display apparatus and the cover apparatus and so as to coordinate with the first and second sets of symbols.

Further in accordance with an embodiment of the invention, the cover apparatus also defines fourth and sixth display locations and the apparatus also comprises fourth selectable display apparatus on which there is provided a fourth group of symbols, a fourth set of symbols selected from the fourth group being displayed at the fourth display location so as to be observable through the cover apparatus; and fifth selectable display apparatus on which there is provided a fifth group of symbols supplementary to the fourth group of symbols, the fourth display apparatus defining a plurality of fifth display locations at which a fifth set of symbols, taken from the fifth group, may be displayed so as to be observable through the fourth display apparatus and the cover apparatus and so as to coordinate with an additional first set taken from the first group of symbols and displayed at the sixth display location and with the fourth set of symbols displayed at the fourth display location.

Additionally in accordance with an embodiment of the invention, the apparatus is a calendar and the cover apparatus also defines a seventh display location, each second set and fourth set of symbols respectively provided on the second and fourth display apparatus being a calendar month, being a month selected to correspond with displayed symbols of the respective first and additional first sets, each symbol of the first and additional first sets of symbols being encoded so as to correspond to a predetermined year in a multi-annual cycle, there also being provided on the first display apparatus an indication of a year for visual display at the seventh display location and to which the displayed first and additional first sets of symbols correspond.

Further in accordance with an embodiment of the invention, the calendar is a solar calendar operative to provide a display of any selected month in a twenty eight year solar cycle.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
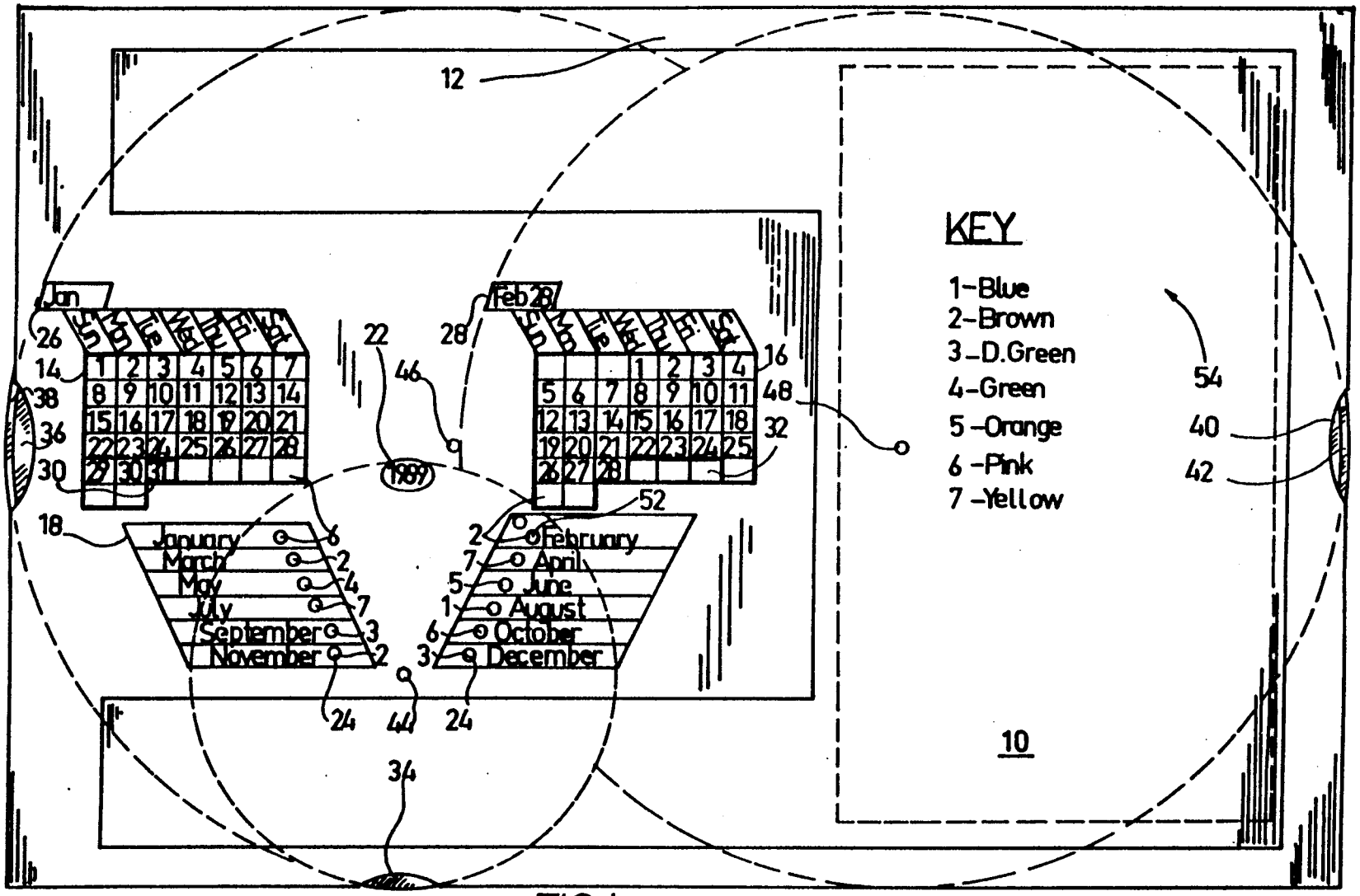
FIG. 1 is an illustration of a calendar, constructed and operative in accordance with a preferred embodiment of the invention.

Reference is now made to FIG. 1, in which there is shown a wall-chart style calendar, referenced generally 10, constructed and operative in accordance with a preferred embodiment of the present invention. Calendar 10 is a twenty eight year solar cycle calendar which, it will be appreciated, may be applied to any predetermined twenty eight year period and is completely repetitive.

Although calendar 10 is, as stated, a twenty eight year solar cycle calendar, the underlying principles of the invention may be applied equally to any other cycle that may be represented, in a similar way to that of the calendar of the invention, by characters or other symbols.

Calendar 10 comprises a cover member 12 defining an 'odd' display window 14 at which a date array of a selected 'odd' month, for example, January, is displayed and also defining an 'even' display window 16 at which a date array of a selected 'even' month, for example, February, is displayed. Days of the week are listed adjacent to windows 14 and 16, as shown, such that in a displayed month, the day/date correspondence may be determined easily.

The names of the odd and even months of the year are listed below respective windows 14 and 16 and odd and even pluralities of windows respectively referenced 18 and 20. display predetermined selectable coded symbols corresponding to a different date array appearing in windows 14 and 16.

According to a preferred embodiment of the invention, correspondence between the listed months and the months as displayed at windows 14 and 16 is provided by a color coding scheme. Therefore, in order to ensure day/date correspondence with a selected year, for example, 1989, as displayed at a 'year' window 22, background coloring of the date array displayed at windows 14 and 16 must correspond to the color of a dot 24 displayed in either of the pluralities of windows 18 or 20 and relating to a selected month. A typical color coding scheme is shown in FIG. 1.

The names of the months displayed are provided at respective month windows 26 and 28, while supplementary dates, where applicable, are displayed at respective supplementary windows 30 and 32. As the odd months all have 30 or 31 days, a single supplementary date is selectably provided in odd supplementary window 30. As an even month, namely February, may have as few as 28 days, however, up to three supplementary dates may be provided at even supplementary window 32.

Figure 2:
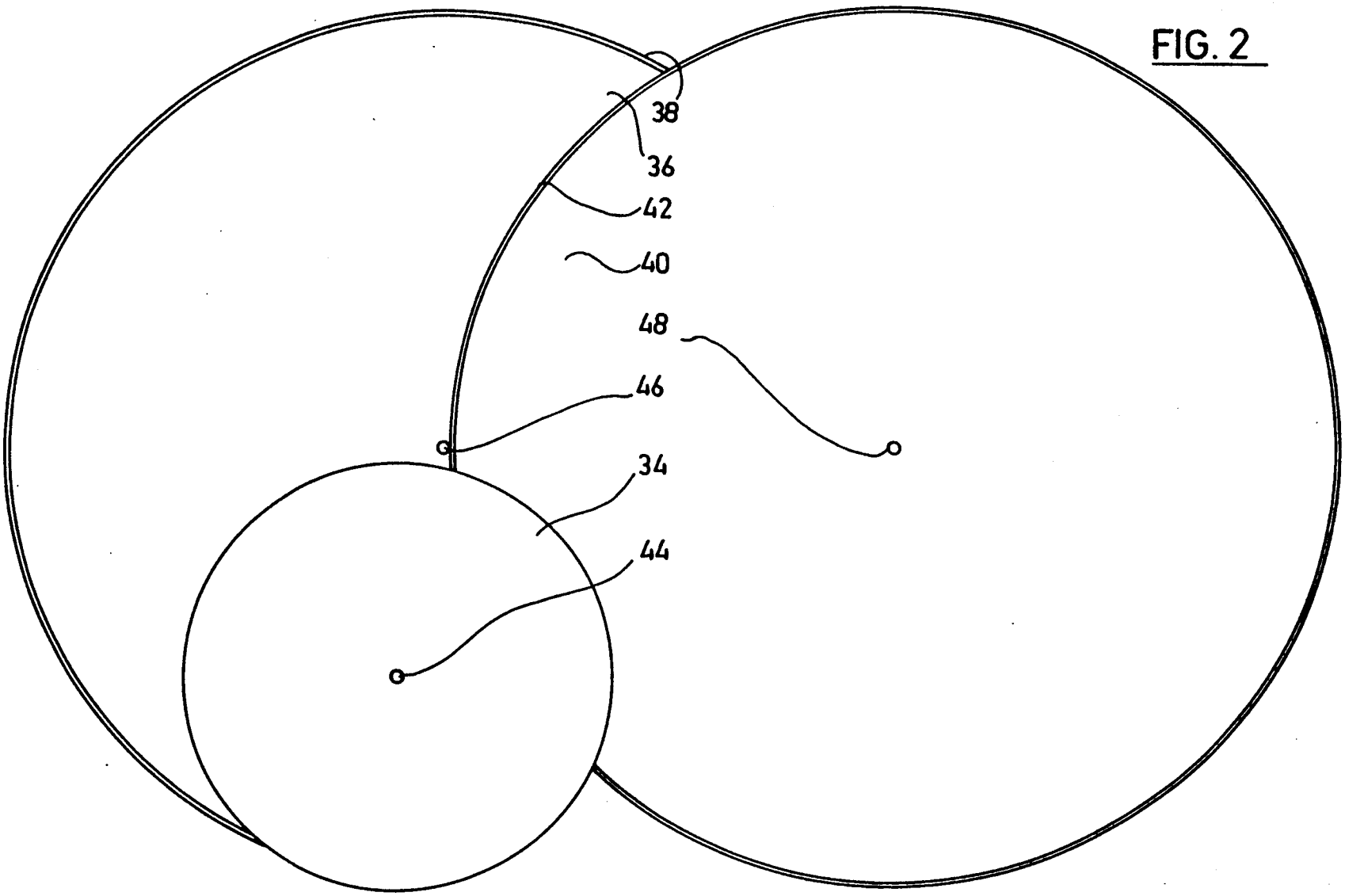
FIG. 2 is an illustration showing the respective positions of first, second, third, fourth and fifth display members of the calendar of FIG. 1.

Referring additionally to FIG. 2, and as is described in detail below with reference to FIGS. 3 to 5B, each of the various displays is provided on one of first, second, third, fourth or fifth disc-shaped display members, respectively referenced 34, 36, 38, 40 and 42.

According to the shown embodiment, second member 36 has a slightly smaller diameter than third member 38 and lies thereover, fourth member 40 has a slightly smaller diameter than fifth member 42 and lies thereover, members 40 and 42 lying partially over members 34 and 38, while first member 34 has a much smaller diameter than the other members and typically lies partially over them all.

Cover member 12 is preferably planar and defines first, second and third axes of rotation, respectively referenced 44, 46 and 48 and upon which are respectively mounted for selectable rotation, first member 34; second member 36 and third member 38; and fourth member 40 and fifth member 42. As will be appreciated with further reference to FIG. 1, axes of rotation 44, 46 and 48 are located such that members 34, 36, 38, 40 and 42 partially protrude from cover 12 so as to be conveniently rotatable.

Figure 3:
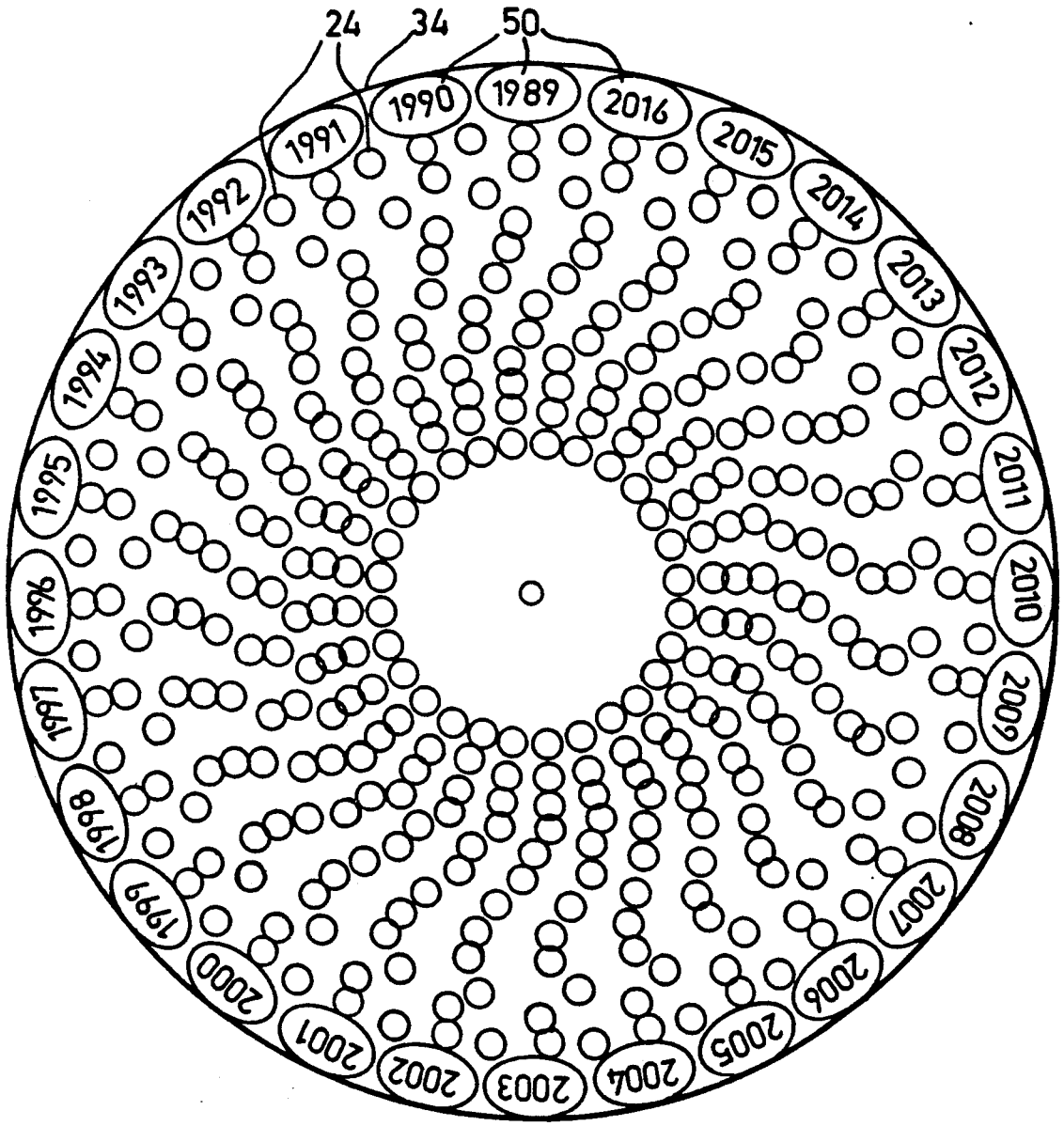
FIG. 3A is a detailed enlarged view of the first display member shown in FIGS. 1 and 2.
FIG. 3B is an enlarged view of the first display member showing only those colored dots corresponding to the example shown in FIG. 1.

Reference is now made to FIG. 3, in which there is shown, in enlarged form, first display member 34 on which there are provided a peripheral arrangement of year indications 50 and a plurality of colored dots 24 relating to each month in a particular year. A cycle of 28 years is provided starting, for example, at 1989 and terminating at 2016. It will be appreciated that the cycle, being totally repetitive and complete would be equally valid if a different 28 year cycle were chosen. Thus, if calendar 10 of the present invention were to commence in the year 1990, display member 34 may be 'updated' by replacing the 1989 indication with the year 2017.

Figure 4A:
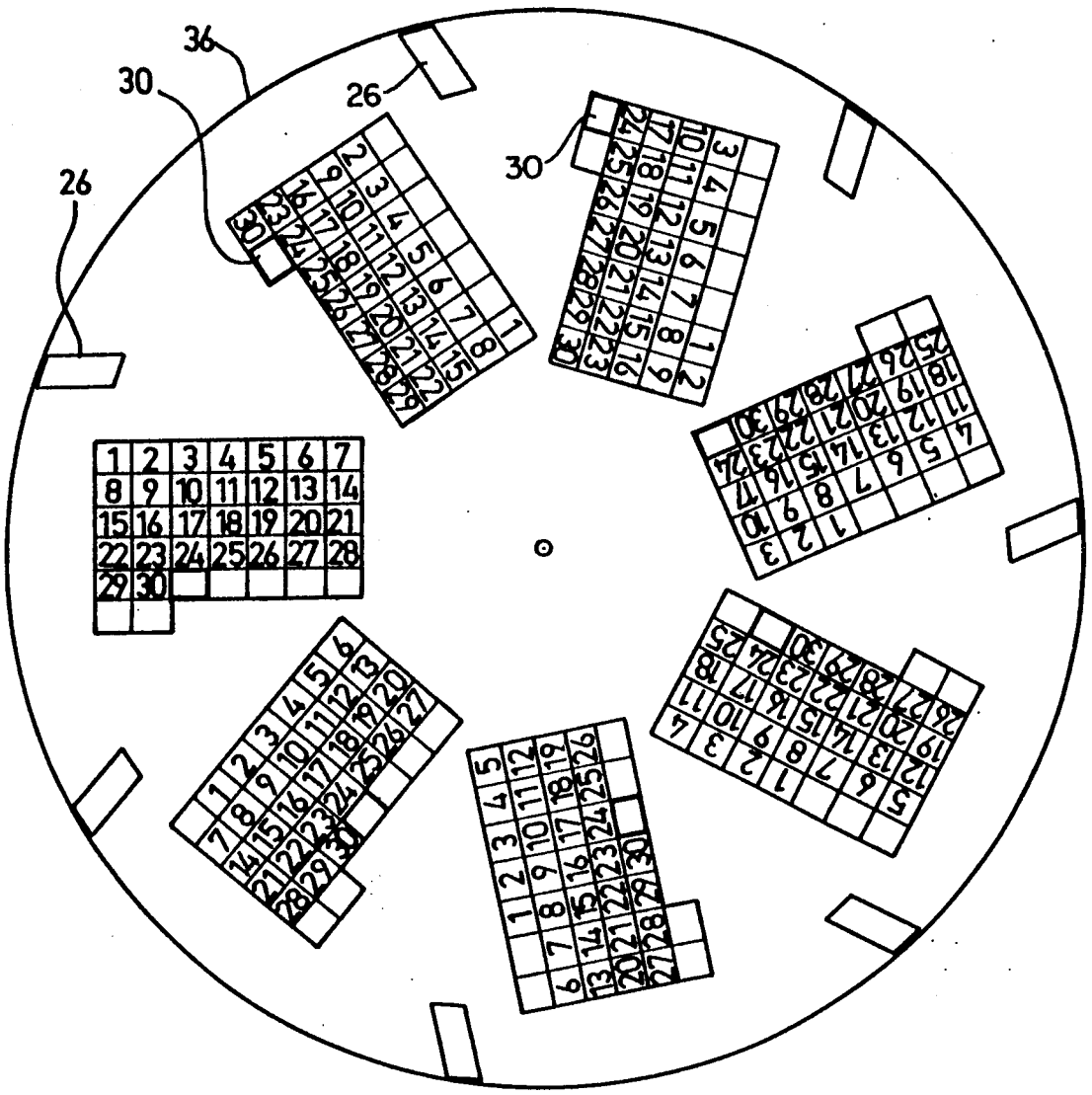
FIG. 4A is a detailed illustration of the second display member shown in FIGS. 1 and 2.

The colored dots 24 are arranged on member 34 such that when a selected year is displayed at window 20 (FIG. 1). predetermined colored dot arrays will be displayed at respective odd and even pluralities of windows, 18 and 20. Referring now to FIG. 4A, seven months are provided on second display member 36, each beginning on a different day of the week. Each month is provided with a different color, corresponding to the color of a dot 24 (FIGS. 1 and 3) displayed at one of windows 18 (FIG. 1).

Figure 4B:
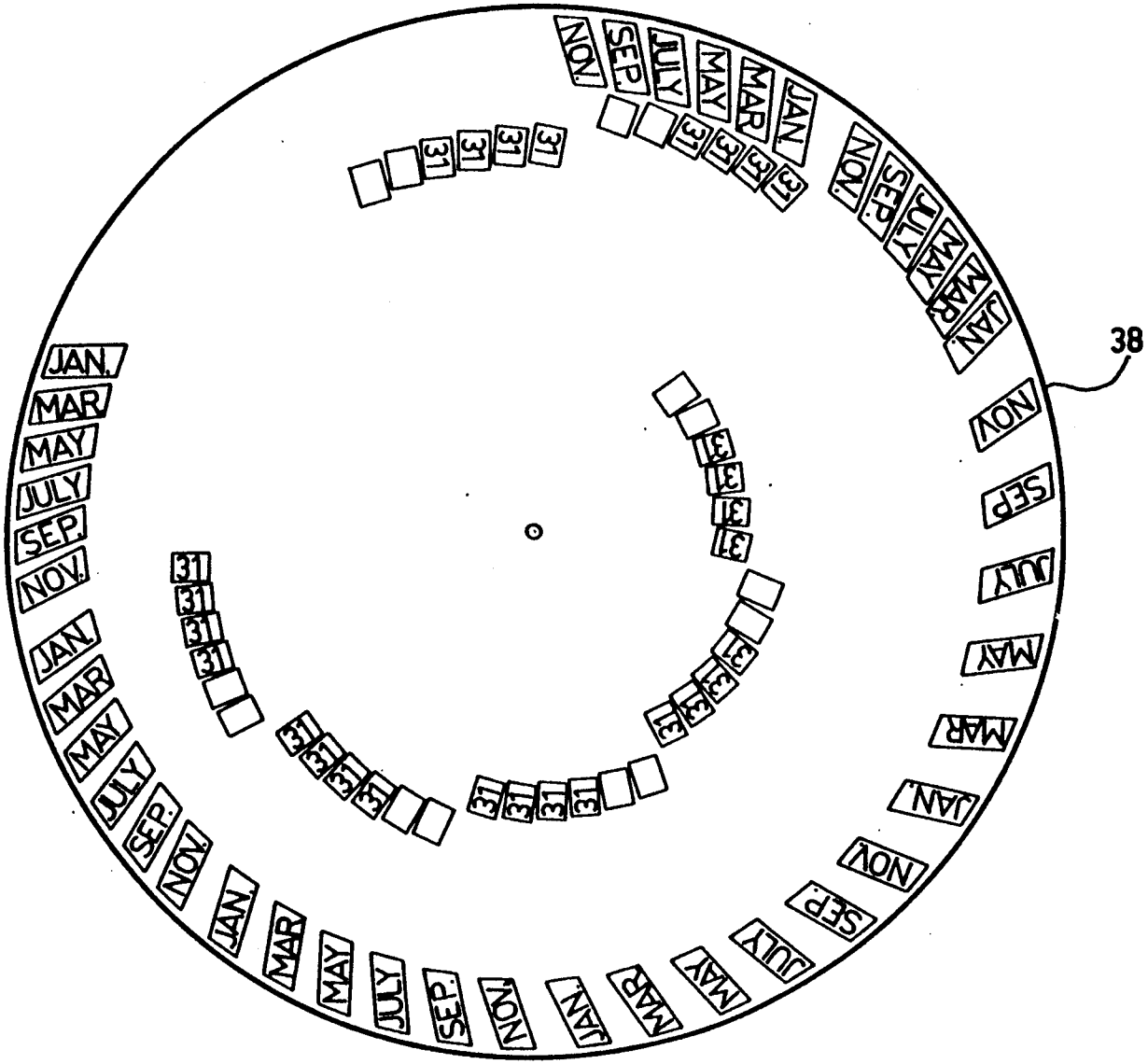
FIG. 4B is a detailed illustration of the third display member shown in FIGS. 1 and 2.

Referring additionally to FIG. 4B, third display member 38 defines a peripheral arrangement of months and a display of supplementary dates. As each of the odd months has either 30 or 31 days, the 31st of the month is the only supplementary date which, when required, is displayed. The supplementary date is displayed at a predetermined one of windows 30 defined by first member 34. In correspondence with the seven months provided on second member 36, the peripherally arranged months and the display of supplementary dates are also typically provided in seven groups.

Figure 5A:
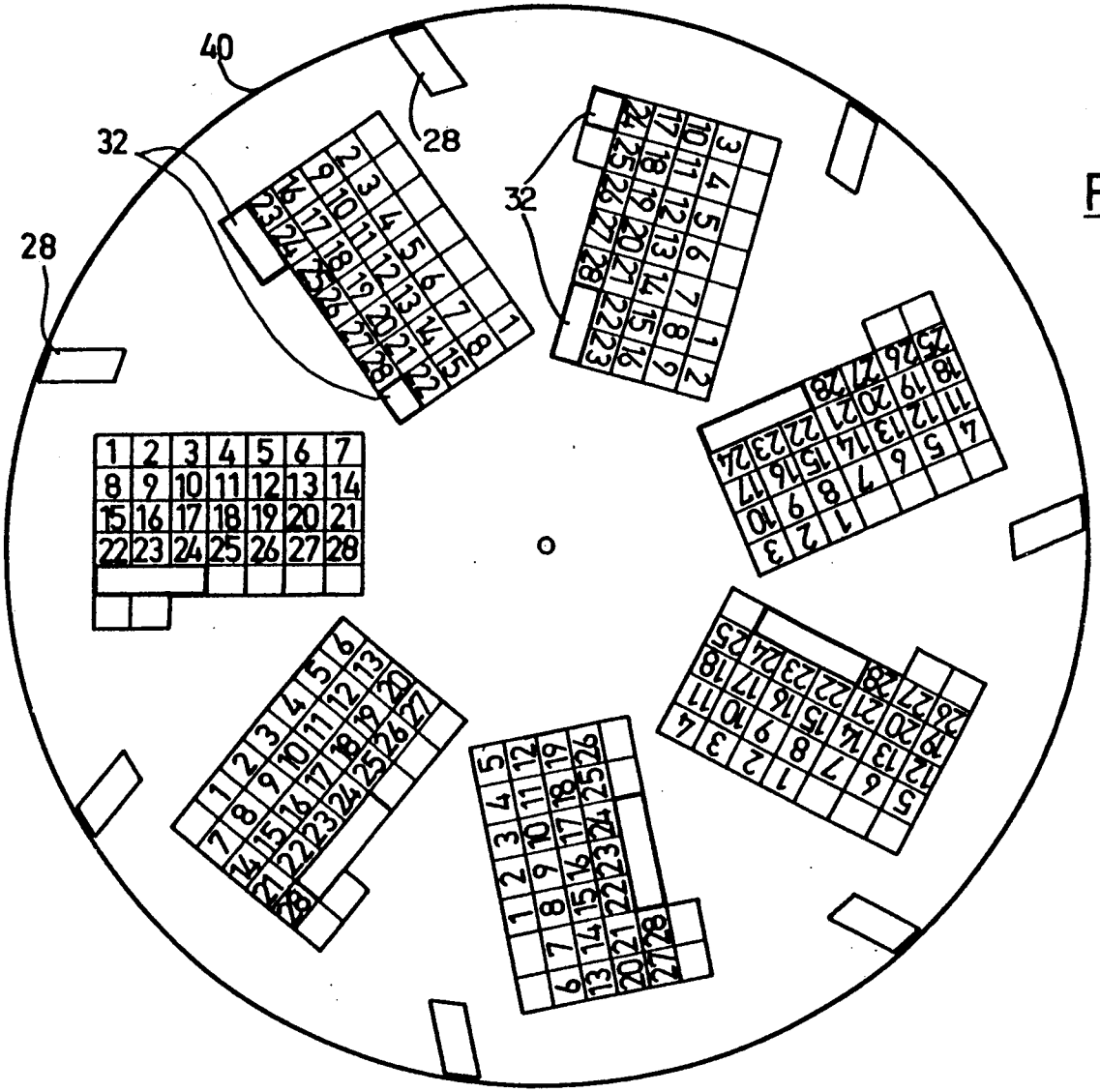
FIG. 5A is a detailed illustration of the fourth display member shown in FIGS. 1 and 2.
Figure 5B:
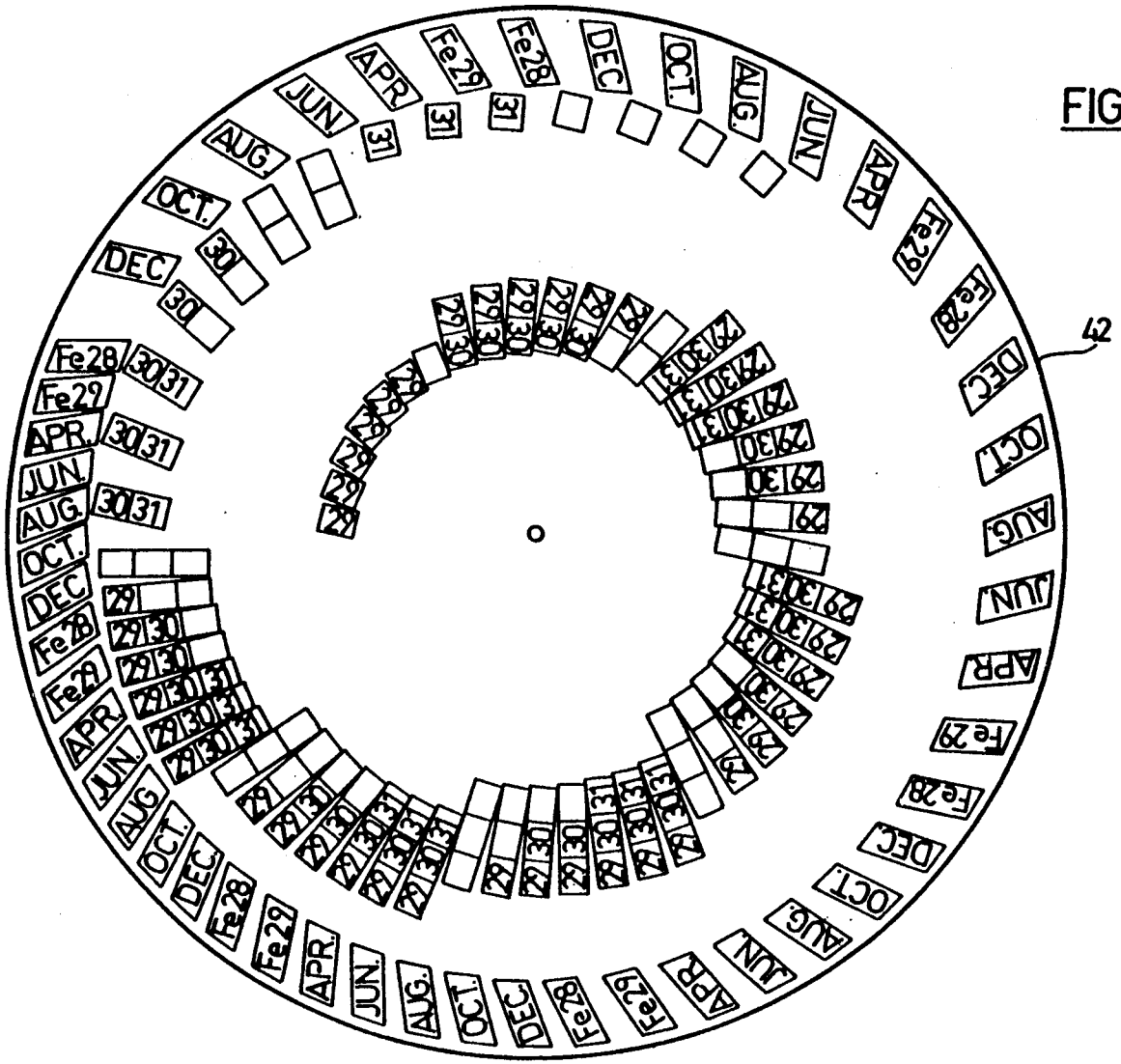
FIG. 5B is a detailed illustration of the fifth display member shown in FIGS. 1 and 2.

Referring now briefly to FIGS. 5A and 5B, fourth and fifth display members, respectively 40 and 42, correspond and serve similar purposes to second and third display members, 36 and 38, but for the even months of the year.

Referring once again to FIG. 1, operation of the calendar will be described. To display a selected month of a selected year, for example, February 1989, first member 34 is rotated until '1989' is displayed at window 22. Referring now to the list of even months and to the corresponding plurality of windows 20, bearing in mind that 1989 is not a leap year and, therefore, February has 28 days, the color of dot 24 appearing in the lower window 52 of the pair of windows corresponding to February, is noted. According to the key shown in FIG. 1, the February dot is colored brown.

Fourth display member 40 is then rotated such that a February display also colored brown, appears at window 16. Finally, fifth display member 42 is rotated until the legend 'Feb. 28', also colored brown, appears at window 28, while blank spaces of the same color are displayed at supplementary date display window 32.

According to a preferred embodiment of the invention, an area 54, defined by the broken outline on cover 12, may be used for supporting a decorative medium, such as one or a plurality of pictures.

Cover 12 and display members 34–42 are preferably thin planar members and made of any suitable material as known in the art. Calendar 10 is, therefore, made typically from paper products such as card, plastic, any suitable laminated combination of materials or metal.

It will be appreciated by persons skilled In the art that the present invention is not limited by the particular example as shown and described above in conjunction with the drawings. The scope of the invention is limited, rather, solely by the claims, which follow:

We claim:

1. Apparatus for selectably displaying one of a plurality of predetermined combinations of symbols taken from respective first, second, third, fourth and fifth respective groups of symbols comprising:

display means; and a planar cover for said display means, said planar cover having an arrangement of first display windows, a single second display window, a single third display window, and an arrangement of fourth display windows; said planar cover also defining first, second and third rotation axes respectively associated with said arrangements of first and fourth display windows, said second display window and said third display window, said display means comprising:

a first planar display member on which is provided said first group of symbols and which is mounted for rotation about said first axis in a plane parallel to said cover so as to permit alignment of predetermined symbols of said first group of symbols in registration with respective ones of each of said arrangements of first and second display windows so as to be displayed thereat;

a second planar display member on which is provided said second group of symbols and which is mounted for rotation about said second axis in a plane parallel to said cover so as to permit alignment of one of a plurality of predetermined portions of said second group of symbols, corresponding to a predetermined symbol of said first group of symbols displayed at said one of said arrangement of first windows, in registration with said second window so as to be displayed thereat, said second planar display member further having a fifth display window adjacent to each said predetermined portion of said second group of symbols;

a third planar display member on which is provided said third group of symbols, said third planar display member also being mounted for rotation about said second axis in a plane parallel to said cover so as to permit alignment of a number of predetermined symbols of said third group of symbols, supplementary to said displayed portion of said second group of symbols, in registration with a predetermined fifth display window so as to be displayed thereat;

a fourth planar display member on which is provided said fourth group of symbols and which is mounted for rotation about said third axis in a plane parallel to said cover so as to permit alignment of one of a plurality of predetermined portions of said fourth group of symbols, corresponding to a predetermined symbol of said first group of symbols displayed at said arrangement of fourth windows, in registration with said third window so as to be displayed thereat, said fourth planar display member further having a sixth display window adjacent to each said predetermined portion of said fourth group of symbols; and a fifth planar display member on which is provided said fifth group of symbols, said fifth planar display member also being mounted for rotation about said third axis in a plane parallel to said planar cover so as to permit alignment of a number of predetermined symbols of said fifth group of symbols, supplementary to said displayed plurality of said fourth group of symbols, in registration with a predetermined sixth display window so as to be displayed thereat.

2. A multi-annular calendar comprising:

display means; and a planar cover for said display means, said planar cover having an arrangement of first display windows, a single second display window, a single third display window, an arrangement of fourth display windows, and a year indication display window; said planar cover also defining first, second and third rotation axes respectively associated with said arrangements of first and fourth display windows and said year indication display window, said second display window, and said third display window, said display means comprising:

a first planar display member mounted for rotation about said first axis in a plane parallel to said planar cover, said first display member having a plurality of year indications provided at a predetermined distance from said first axis equal to the distance of said year indication display window from said first axis so as to permit alignment of a selected year indication in registration with said year indication display window so as to be displayed thereat, said first display member further having a first group of symbols each being encoded to correspond to a different predetermined month in a different predetermined year, said first group of symbols being arranged relative to said first axis so as to permit alignment of a predetermined plurality of said symbols encoded to correspond to all of the months of a selected year displayed at said year indication display window in registration with each of said arrangements of first and fourth windows so as to be displayed thereat;

a second planar display member on which is provided a second group of symbols comprising a first plurality of encoded calendar month arrays, said second planar display member being mounted for rotation about said second axis in a plane parallel to said planar cover so as to permit alignment of a selected encoded calendar month array, corresponding to a selected one of said encoded first symbols displayed at said arrangement of first display windows, in registration with said second window so as to be displayed thereat, said second planar display member further having a fifth display window adjacent to each said calendar month array;

a third planar display member on which is provided a third group of symbols comprising a plurality of date indications supplementary to said first plurality of encoded calendar month arrays, said third planar display member also being mounted for rotation about said second axis in a plane parallel to said planar cover so as to permit alignment of a number of predetermined date indications supplementary to said displayed calendar month array of said first plurality of encoded calendar month arrays, in registration with a predetermined fifth display window so as to be displayed thereat;

a fourth planar display member on which is provided a fourth group of symbols comprising a second plurality of encoded calendar month arrays, said fourth planar display member being mounted for rotation about said third axis in a plane parallel to said planar cover so as to permit alignment of a selected encoded calendar month array, corresponding to a selected one of said encoded first symbols displayed at said arrangement of fourth display windows, in registration with said third window so as to be displayed thereat, said fourth planar display member further having a sixth display window adjacent to each of said plurality of encoded calendar month arrays; and a fifth planar display member on which is provided a fifth group of symbols comprising a plurality of date indications supplementary to said second plurality of encoded calendar month arrays, said fifth planar display member also being mounted for rotation about said third axis in a plane parallel to said planar cover so as to permit alignment of a number of predetermined date indications, supplementary to said displayed calendar month array of said second plurality of encoded calendar month arrays, in registration with a predetermined fifth display window so as to be displayed thereat.

3. A twenty eight year solar cycle calendar comprising:

a planar cover for said display means, said planar cover having an arrangement of first display windows, a single second display window, a single third display window, an arrangement of fourth display windows, and a year indication display window; said planar cover also defining first, second and third rotation axes respectively associated with said arrangements of first and fourth display windows and said year indication display window, said second display window, and said third display window, said display means comprising:

a first planar display member mounted for rotation about said first axis in a plane parallel to said planar cover, said first display member having twenty eight predetermined solar cycle year indications arranged at a predetermined distance from said first axis corresponding to the distance of said year indication display window from said first axis so as to permit alignment of a selected year indication in registration with said year display window so as to be displayed thereat, said first display member further having a first group of symbols each being encoded to correspond to a different predetermined month in a predetermined one of said twenty eight years, said first group of symbols being arranged relative to said first axis so as to permit alignment of a predetermined plurality of said symbols encoded to correspond to all the months of a selected year displayed at said year indication display window, in registration with each of said arrangements of first and fourth windows so as to be displayed thereat;

a second planar display member on which is provided a second group of symbols comprising a first plurality of encoded calendar month arrays, said second planar display member being mounted for rotation about said second axis in a plane parallel to said planar cover so as to permit alignment of a selected encoded calendar month array, corresponding to a selected one of said encoded first symbols displayed at said arrangement of first display windows, in registration with said second window so as to be displayed thereat, said second planar display member further having a fifth display window adjacent to each said calendar month array;

a third planar display member on which is provided a third group of symbols comprising a plurality of date indications supplementary to said first plurality of encoded calendar month arrays, said third planar display member also being mounted for rotation about said second axis in a plane parallel to said planar cover, so as to permit alignment of a number of predetermined date indications, supplementary to said displayed calendar month array of said first plurality of encoded calendar month arrays, in registration with a predetermined fifth display window so as to be displayed thereat;

a fourth planar display member on which is provided a fourth group of symbols comprising a second plurality of encoded calendar month arrays, said fourth planar display member being mounted for rotation about said third axis in a plane parallel to said planar cover so as to permit alignment of a selected encoded calendar month array, corresponding to a selected one of said encoded first symbols displayed at said arrangement of fourth display windows, in registration with said third window so as to be displayed thereat, said fourth planar display member further having a sixth display window adjacent to each of said plurality of encoded calendar month arrays; and a fifth planar display member on which is provided a fifth group of symbols comprising a plurality of date indications supplementary to said second plurality of encoded calendar month arrays, said fifth planar display member also being mounted for rotation about said third axis in a plane parallel to said planar cover so as to permit alignment of a number of predetermined date indications supplementary to said displayed calendar month array of said second plurality of encoded calendar month arrays, in alignment with a predetermined fifth display window so as to be displayed thereat.

* * * * *